US007810182B1

(12) United States Patent
Trippodo

(10) Patent No.: US 7,810,182 B1
(45) Date of Patent: Oct. 12, 2010

(54) ANIMATED-FIGURES-ROCKED CRADLE FOR AMUSING AND ROCKING AN INFANT

(76) Inventor: Philip Trippodo, 8 Victory Rd., Patterson, NY (US) 11563

( * ) Notice: Subject to any disclaimer, the term of this patent is extended or adjusted under 35 U.S.C. 154(b) by 131 days.

(21) Appl. No.: 12/229,546

(22) Filed: Aug. 25, 2008

(51) Int. Cl.
*A47D 9/00* (2006.01)

(52) U.S. Cl. ..... 5/103; 5/101; 5/108; 446/73; 446/227; D6/385; D6/388

(58) Field of Classification Search ..... 5/93.1, 5/101–109, 907; 446/73, 227, 322; D6/331, D6/344, 382, 385, 388; 128/845
See application file for complete search history.

(56) References Cited

U.S. PATENT DOCUMENTS

| | | | | |
|---|---|---|---|---|
| D547 | S | | 2/1853 | Edmonds |
| 132,745 | A | | 11/1872 | Batley |
| 204,944 | A | | 6/1878 | Bernhard |
| 430,616 | A | | 6/1890 | Brewer |
| D25,675 | S | | 6/1896 | Robinson |
| 825,133 | A | | 6/1906 | Morse |
| 992,602 | A | * | 5/1911 | Russell ..... 5/101 |
| 1,132,432 | A | | 3/1915 | Brzozowski |
| D102,209 | S | | 12/1936 | Kuhn |
| D147,787 | S | * | 11/1947 | Guastella ..... D6/385 |
| D167,295 | S | | 7/1952 | Arliss ..... D34/15 |
| D180,162 | S | | 4/1957 | Scoggins ..... D5/4 |
| D188,176 | S | | 6/1960 | Billhimer, Sr. ..... D5/5 |
| D22,325 | S | | 10/1971 | Curtis ..... D6/1 |
| 3,821,822 | A | | 7/1974 | Borreggine ..... 5/109 |

* cited by examiner

*Primary Examiner*—Robert G Santos
*Assistant Examiner*—Nicholas Polito
(74) *Attorney, Agent, or Firm*—Bernard S. Hoffman

(57) ABSTRACT

An animated-figures-rocked cradle for amusing and rocking an infant. The animated-figures-rocked cradle includes a cradle and a pair of animated figures. The cradle is pivotally mounted to the pair of animated figures and holds the infant. The pair of animated figures amuse the infant and support and rock the cradle.

19 Claims, 8 Drawing Sheets

ANIMATED-FIGURES-ROCKED CRADLE FOR AMUSING AND ROCKING AN INFANT

1. BACKGROUND OF THE INVENTION

A. Field of the Invention

The embodiments of the present invention relate to a cradle, and more particularly, the embodiments of the present invention relate to an animated-figures-rocked cradle for amusing and rocking an infant.

B. Description of the Prior Art

Cradles for infants have been available for many years, and since it is considered advantageous to provide a rocking motion for the cradle, many of the cradles are supported by rocker elements that can be utilized for rocking the cradle to and fro. Of course, the rocking motion usually extends through a relatively short time period and must be manually or otherwise renewed frequently in order to achieve any lasting effects for the infant disposed in the cradle.

Countless different designs for infant beds, hammocks, and cradles have heretofore been introduced into the marketplace. It is a natural objective of articles of this type to receive an infant with security and comfort, while also desirably having the advantages of low cost, portability, and convenience of use.

The soporific effects produced by gently rocking an infant have been recognized since antiquity to provide soothing relief to child and parent alike, and cradle makers have crafted many devices for lulling a child off to sleep. The typical cradle rocks about a base or pivot. This results in the traditional swaying-rocking mode in which the infant undergoes a small up-and-down motion in addition to the dominant side-to-side motion. Although other types of rocking motions have potentially soothing effects, they are not commonly found in cradles. In many instances, it is also a desirable objective to permit physical and visual stimulation of the baby while lying within the bed.

Numerous innovations for cradles have been provided in the prior art, which will be described below in chronological order to show advancement in the art, and which are incorporated herein by reference thereto. Even though these innovations may be suitable for the specific individual purposes to which they address, they each differ in structure, and/or operation, and/or purpose from the embodiments of the present invention, in that they do not teach an animated-figures-rocked cradle for amusing and rocking an infant.

(1) U.S. Pat. No. Des. 547 to Edmonds.

U.S. Pat. No. Des. 547 issued to Edmonds on Feb. 22, 1853 teaches an ornamental design for a horilogical cradle.

(2) U.S. Pat. No. 132,745 to Batley.

U.S. Pat. No. 132,745 issued to Batley on Nov. 5, 1872 teaches a child's crib, including hangers, standards, cross pieces, curves, guides, rollers, a frame, and a crib.

(3) U.S. Pat. No. 204,944 to Bernhard.

U.S. Pat. No. 204,944 issued to Bernhard on Jun. 18, 1878 teaches a cradle, including a stand, a crib, longitudinal bent rods passing beneath the bottom of the crib and extending from head to foot, whereby the crib is suspended and a support is afforded for the slats or other bottom.

(4) U.S. Pat. No. 430,616 to Brewer.

U.S. Pat. No. 430,616 issued to Brewer on Jun. 24, 1890 teaches a cradle, including a frame combined with a swinging cradle, and long flat springs. Two or more of the springs are disposed at each end of the frame and have their upper ends secured rigidly to the frame and their lower ends secured rigidly to the bottom of the cradle. The springs are arranged edgewise to the bottom of the cradle and form the sole support and connection between the cradle and its frame, whereby the cradle will be given a noiseless easy motion without friction. The movement is maintained for a long time even after the hand of the operator has been removed.

(5) U.S. Pat. No. Des. 25,675 to Robinson.

U.S. Pat. No. Des. 25,675 issued to Robinson on Jun. 23, 1896 teaches an ornamental design for a cradle.

(6) U.S. Pat. No. 824,133 to Morse.

U.S. Pat. No. 824,133 issued to Morse on Jun. 26, 1906 teaches a cradle, including a frame, a cradle suspended from the frame, and resilient hangers connecting the cradle and frame, respectively, and have their opposite ends curved laterally and rigidly secured thereto. The hangers are free to expand and contract at points adjacent their fixed ends.

(7) U.S. Pat. No. 992,602 to Russell.

U.S. Pat. No. 992,602 issued to Russell on May 16, 1911 teaches a baby rest, including a base, a pair of oppositely disposed removable standards upon the base, an offset member for each of the standards, and hanger arms. Each of the offset members have its extremity formed with a head. Each of the hanger arms includes a central member having its lower portion forked. A body is connected with the forked arms. The central member of each of the hanger arms is formed with an eye. Each of the eyes include a pair of separable members and is adapted to be positioned upon the offset members of the standards. A spring member is adjustably connected with each of the standards. Each of the spring members includes a body portion adapted to straddle the standard and being formed with angular spaced arms. The central member of each of the hanger arms is positioned between the angular spring arms and is adapted to be contacted thereby when the body member is in motion.

(8) U.S. Pat. No. 1,132,432 to Brzozowski.

U.S. Pat. No. 1,132,432 issued to Brzozowski on Mar. 16, 1915 teaches a crib, including a frame having end uprights, a crib, suspending rods between the crip and the uprights, a transverse bar upon the frame and beneath the crib, steadying rods pivoted between the ends of the bar and one end of the crib, and eccentric operating rods carried by the frame and connected to the crib.

(9) U.S. Pat. No. Des. 102,209 to Kuhn.

U.S. Pat. No. Des. 102,209 issued to Kuhn on Dec. 1, 1936 teaches an ornamental design for a baby's bed.

(10) U.S. Pat. No. Des. 167,295 to Arliss.

U.S. Pat. No. Des. 167,295 issued to Arliss on Jul. 22, 1952 in class D34 and subclass 15 teaches an ornamental design for a toy cradle.

(11) U.S. Pat. No. Des. 180,162 to Scoggins.

U.S. Pat. No. Des. 180,162 issued to Scoggins on Apr. 23, 1957 in class D5 and subclass 4 teaches an ornamental design for a child's bed.

(12) U.S. Pat. No. Des. 188,176 to Billhimer, Sr.

U.S. Pat. No. Des. 188,176 issued to Billhimer, Sr. on Jun. 14, 1960 in class D5 and subclass 5 teaches an ornamental design for a baby cradle.

(13) U.S. Pat. No. Des. 222,325 to Curtis.

U.S. Pat. No. Des. 222,325 issued to Curtis on Oct. 19, 1971 in class D6 and subclass 01 teaches an ornamental design for a clown bed.

(14) U.S. Pat. No. 3,821,822 to Borreggine.

U.S. Pat. No. 3,821,822 issued to Borreggine on Jul. 2, 1974 in class 5 and subclass 109 teaches a combination cradle, crib, and youth bed, including a longitudinally oriented base frame including a pair of spaced-apart, upstanding head members facing one another and a longitudinal base member connected between upstanding head members. A body supporting unit has opposite headboards releasably supported by a base frame, and parallel bars associated with each head member of the base frame are pivotally connected between an upper portion of each head member and a lower portion of each headboard of the body supporting unit. Structural relationship between the base frame, the body supporting unit, and the parallel bars enable the unit to swing in a to-and-fro transverse direction relative to the base frame. A separate stabilizer is connected between at least one of the headboards and its adjacent head member for preventing longitudinal play of the body supporting unit when it swings in the to-and-fro transverse direction relative to the base frame.

It is apparent that numerous innovations for cradles have been provided in the prior art that are adapted to be used. Furthermore, even though these innovations may be suitable for the specific individual purposes to which they address, they would not be suitable for the purposes of the embodiments of the present invention as heretofore described, namely, an animated-figures-rocked cradle for amusing and rocking an infant.

2. SUMMARY OF THE INVENTION

Thus, an object of the embodiments of the present invention is to provide an animated-figures-rocked cradle for amusing and rocking an infant that avoids the disadvantages of the prior art.

Briefly stated, another object of the embodiments of the present invention is to provide an animated-figures-rocked cradle for amusing and rocking an infant. The animated-figures-rocked cradle includes a cradle and a pair of animated figures. The cradle is pivotally mounted to the pair of animated figures and holds the infant. The pair of animated figures amuse the infant and support and rock the cradle.

The novel features which are considered characteristic of the embodiments of the present invention are set forth in the appended claims. The embodiments of the present invention themselves, however, both as to their construction and to their method of operation together with additional objects and advantages thereof will be best understood from the following description of the specific embodiments of the present invention when read and understood in connection with the accompanying drawing.

3. BRIEF DESCRIPTION OF THE DRAWING

The figures of the drawing are briefly described as follows.

Figure 1:
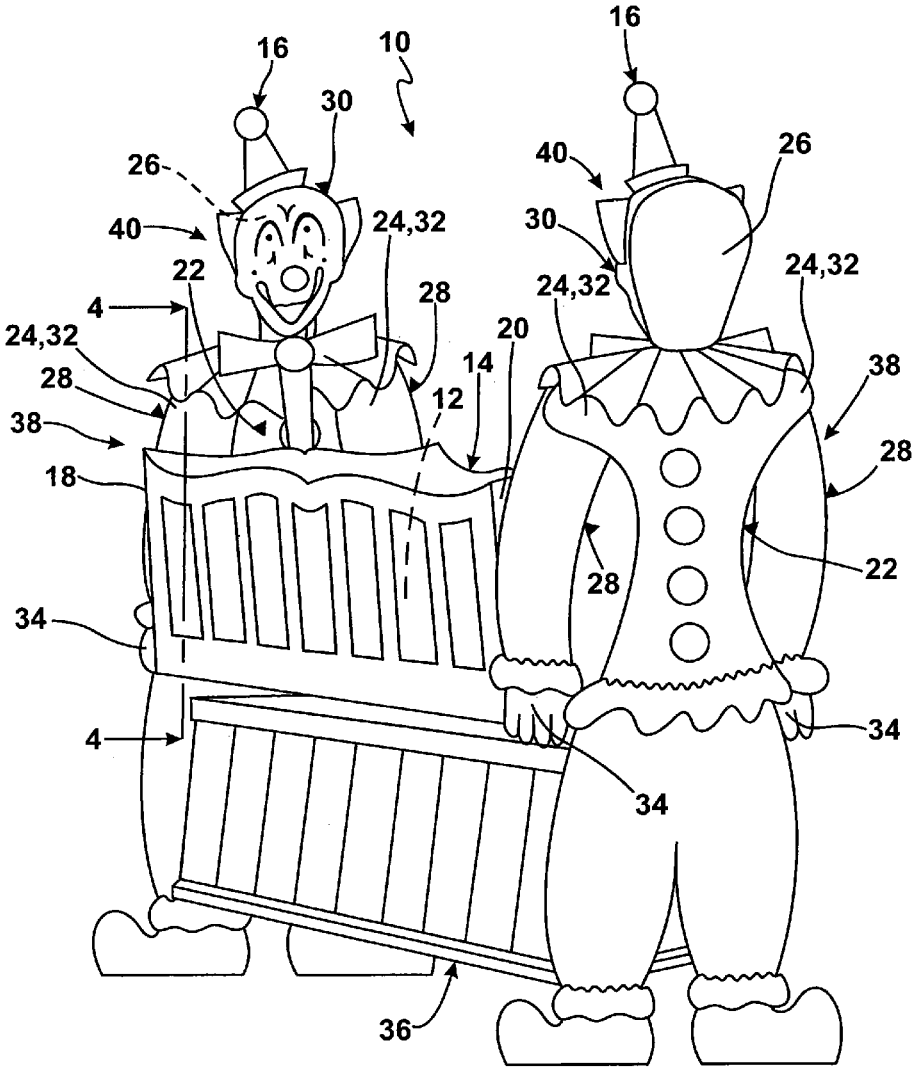
FIG. 1 is a diagrammatic perspective view of the animated-figures-rocked cradle of the embodiments of the present invention amusing and beginning to rocking an infant.
Figure 2:
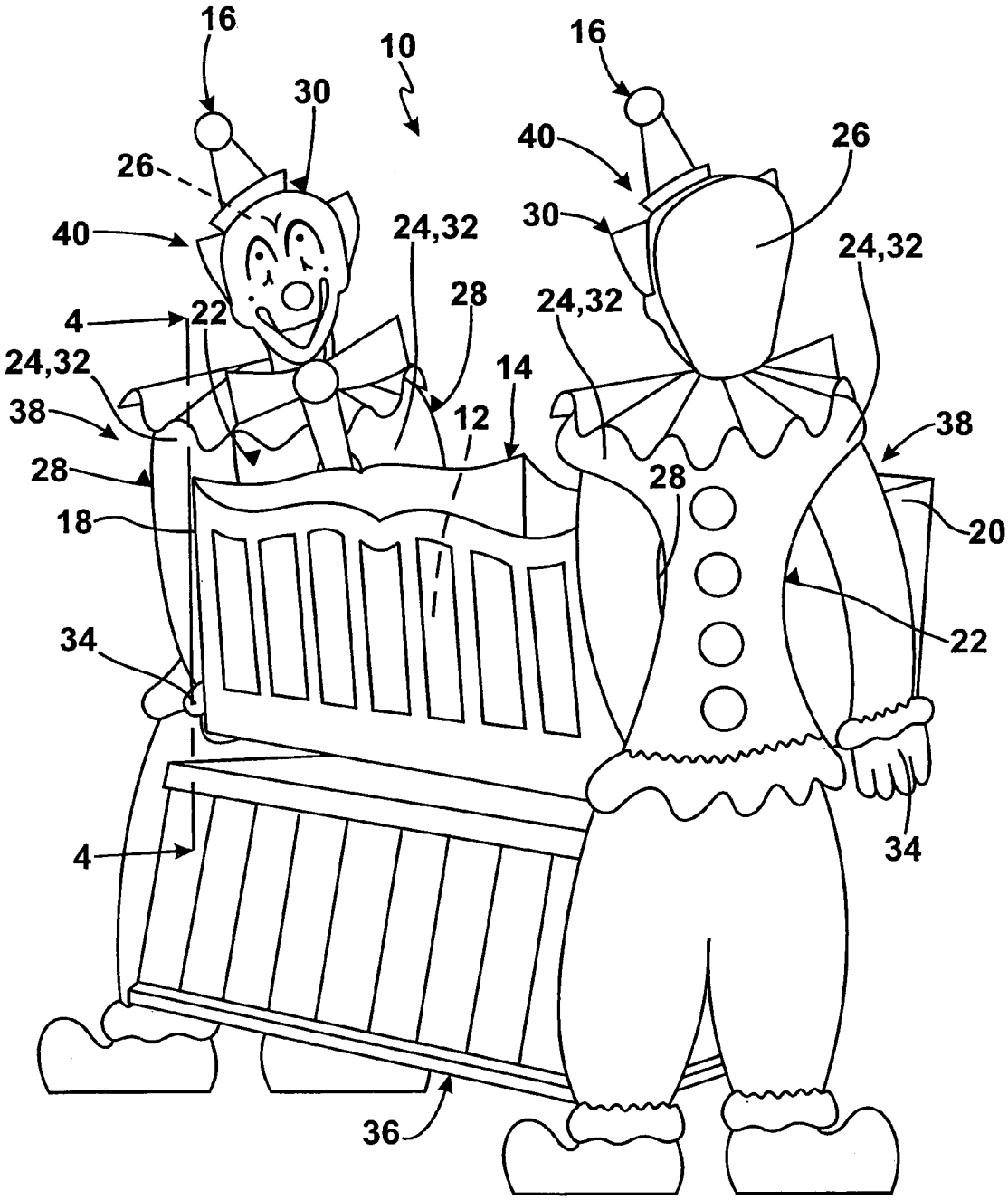
FIG. 2 is a diagrammatic perspective view of the animated-figures-rocked cradle of the embodiments of the present invention amusing and rocking an infant in one direction.
Figure 3:
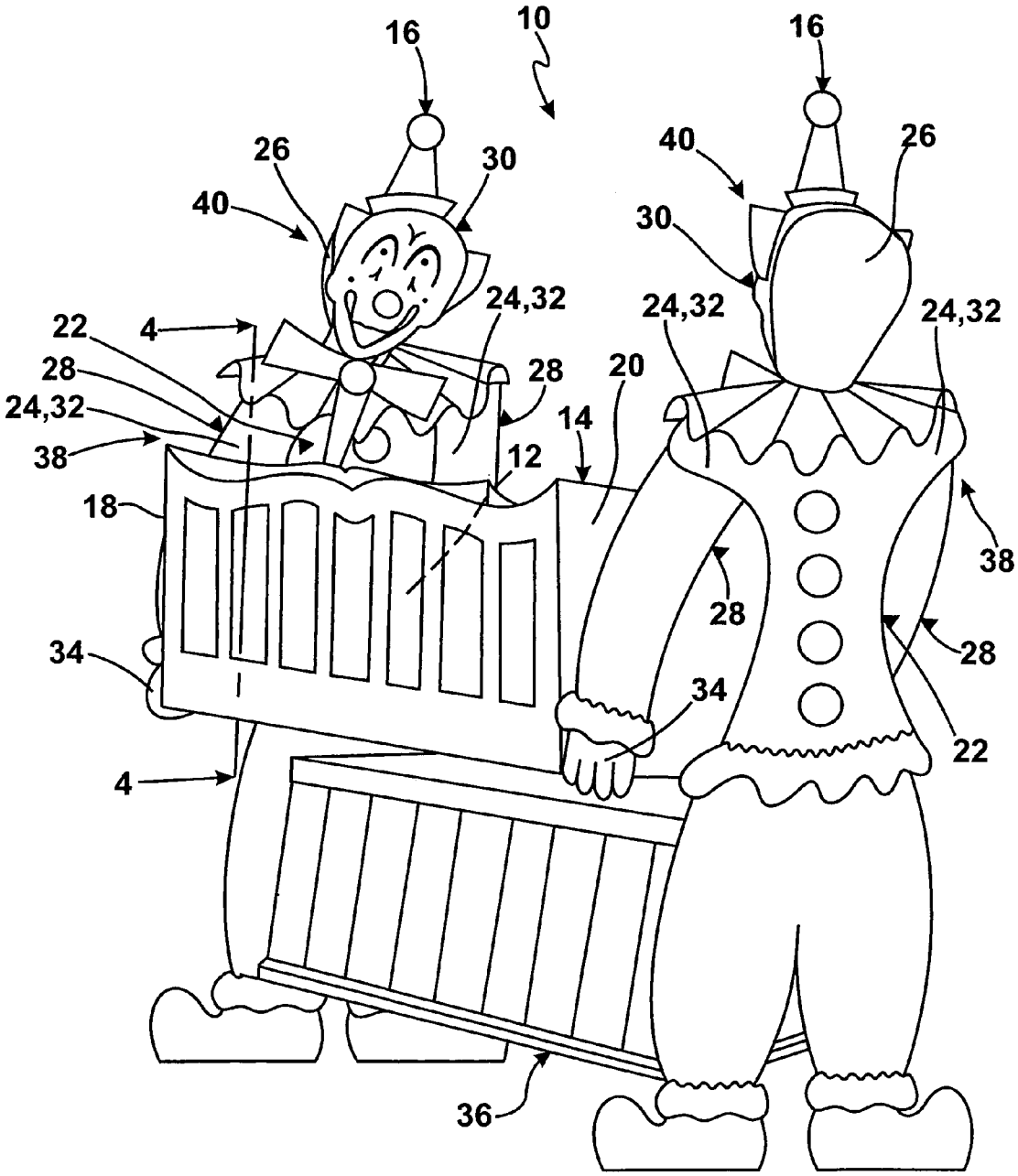
FIG. 3 is a diagrammatic perspective view of the animated-figures-rocked cradle of the embodiments of the present invention amusing and rocking an infant in the opposite direction.
Figure 4:
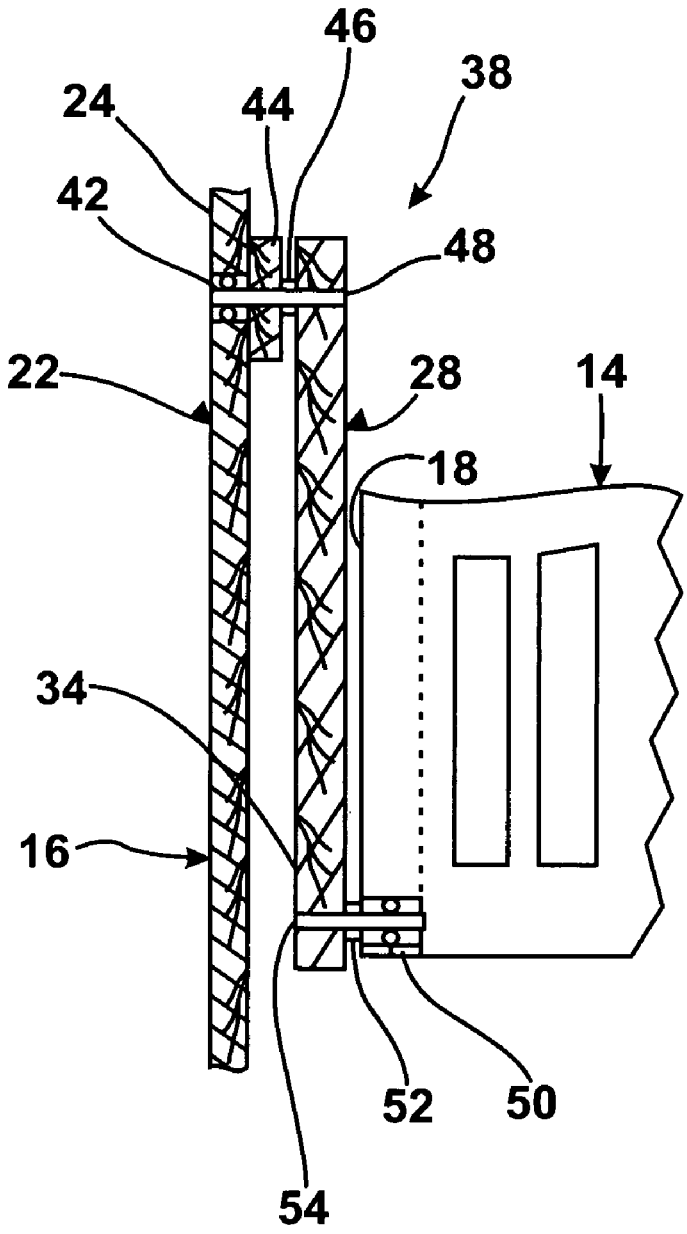
Figure 5:
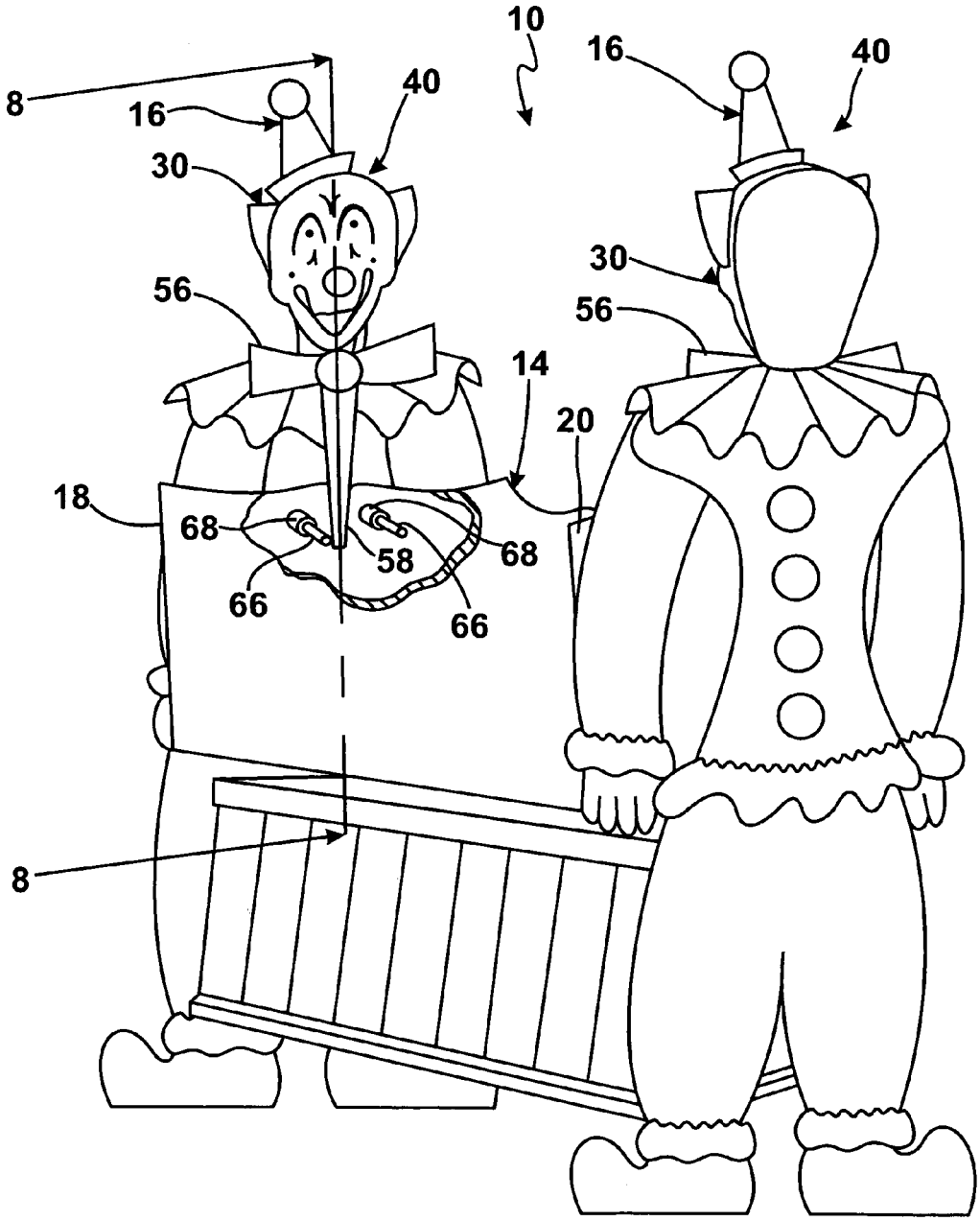
Figure 6:
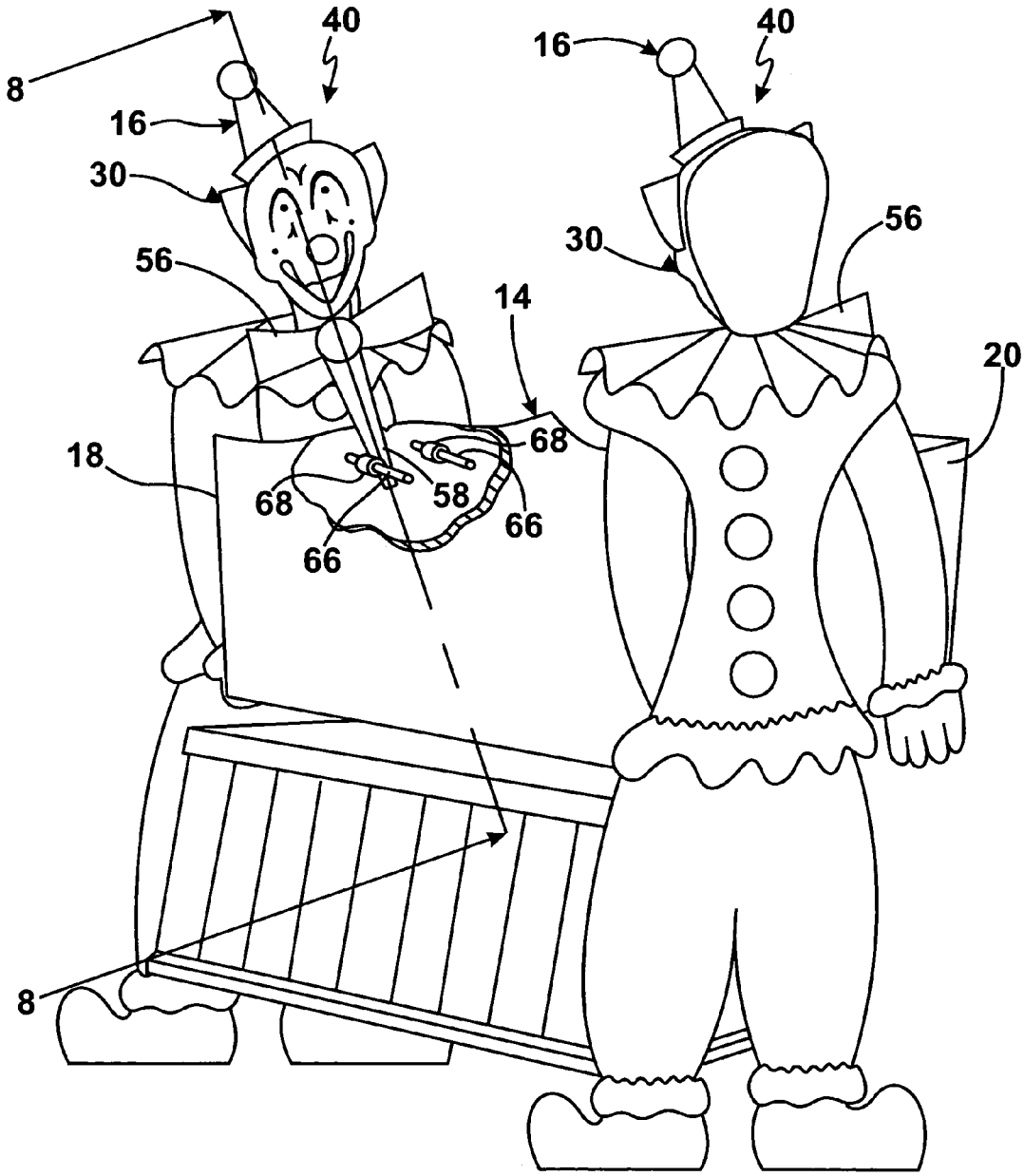
Figure 7:
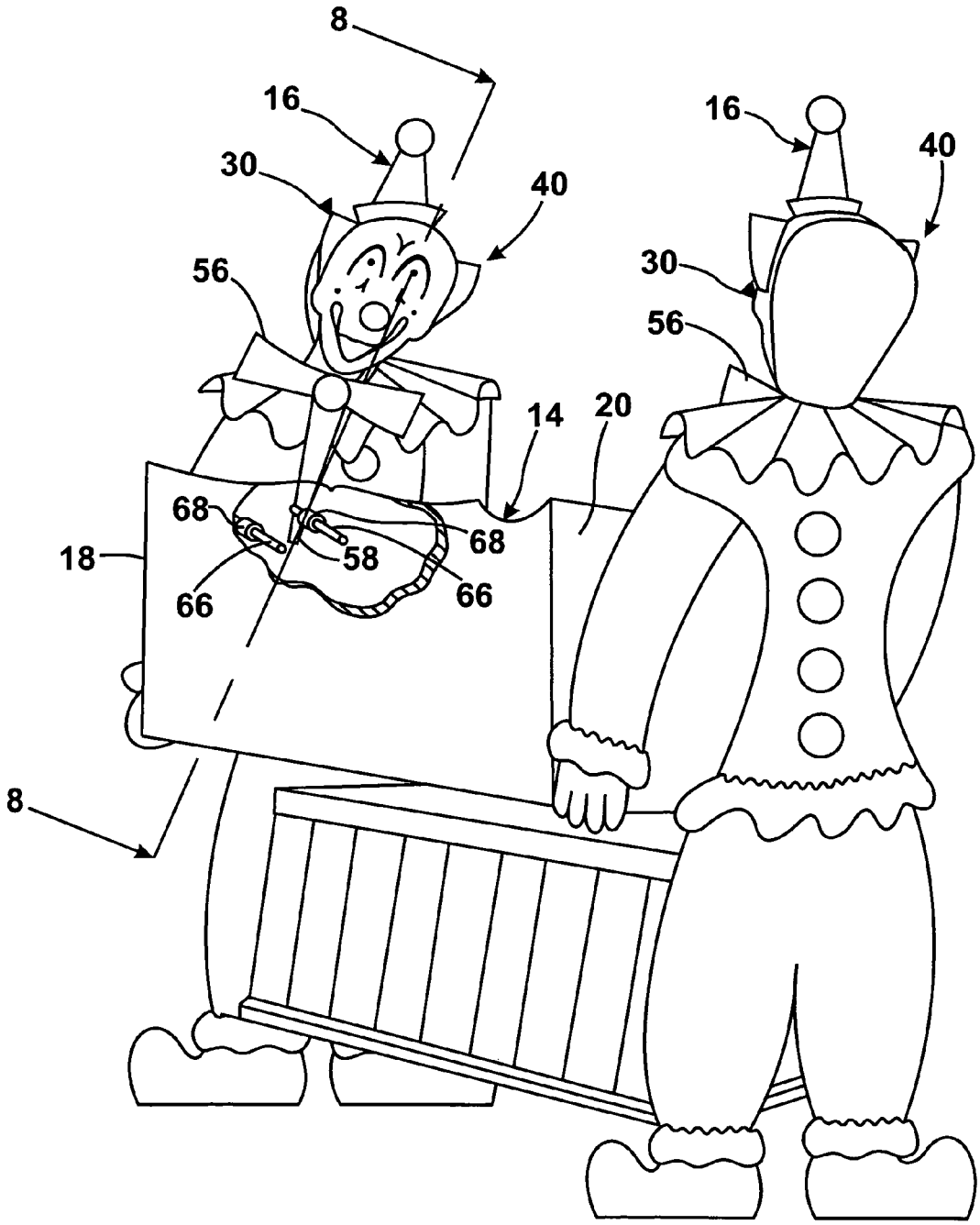
Figure 8:
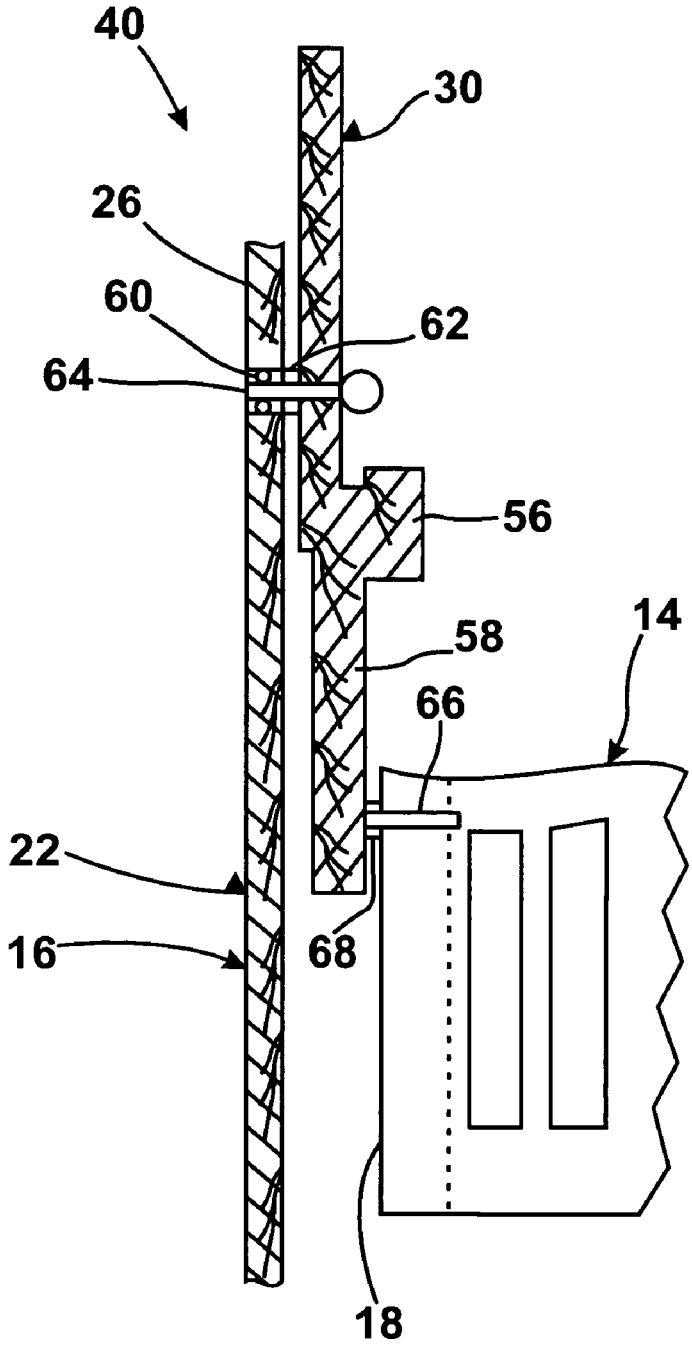

FIG. 4 is an enlarged diagrammatic cross sectional view taken along LINE 4-4 in each of FIGS. 1-3 illustrating how each arm of each animated figure of the animated-figures-rocked cradle of the embodiments of the present invention is pivotally mounted to the pair of shoulders of the torso of an associated animated figure of the animated-figures-rocked cradle of the embodiments of the present invention and to the cradle of the animated-figures-rocked cradle of the embodiments of the present invention;

FIG. 5 is a diagrammatic perspective view with parts broken away illustrating the face of each animated figure of the animated-figures-rocked cradle of the embodiments of the present invention beginning to pivot relative to the head of an associated animated figure of the animated-figures-rocked cradle of the embodiments of the present invention;

FIG. 6 is a diagrammatic perspective view with parts broken away illustrating the face of each animated figure of the animated-figures-rocked cradle of the embodiments of the present invention pivoting in one direction relative to the head of an associated animated figure of the animated-figures-rocked cradle of the embodiments of the present invention;

FIG. 7 is a diagrammatic perspective view with parts broken away illustrating the face of each animated figure of the animated-figures-rocked cradle of the embodiments of the present invention pivoting in the opposite direction relative to the head of an associated animated figure of the animated-figures-rocked cradle of the embodiments of the present invention; and FIG. 8 is an enlarged diagrammatic cross sectional view taken along LINE 8-8 in each of FIGS. 5-7 illustrating how the face of each animated figure of the animated-figures-rocked cradle of the embodiments of the present invention is pivotally mounted to the head of an associated animated figure of the animated-figures-rocked cradle of the embodiments of the present invention and interfaces with the cradle of the animated-figures-rocked cradle of the embodiments of the present invention.

4. LIST OF REFERENCE NUMERALS UTILIZED IN THE DRAWING

A. General

10 animated-figures-rocked cradle of embodiments of present invention for amusing and rocking infant 12
12 infant

B. Overall Configuration of Animated-Figures-Rocked Cradle 10

14 cradle for holding infant 12
16 pair of animated figures for amusing infant 12
18 head of cradle 14
20 foot of cradle 14
22 torso of each animated figure of pair of animated FIG. 16
24 pair of shoulders of torso 22 of each animated figure of pair of animated FIG. 16
26 head of torso 22 of each animated figure of pair of animated FIG. 16
28 pair of arms of each animated figure of pair of animated FIG. 16
30 face of each animated figure of pair of animated FIG. 16

32 upper ends of pair of arms 28 of each animated figure of pair of animated FIG. 16
34 pair of hands of pair of arms 28 of each animated figure of pair of animated FIG. 16
36 storage chest for storing items of infant 12
38 arm-pivoting apparatus
40 face-pivoting apparatus C. Specific Configuration of Arm-Pivoting Apparatus 38

42 pair of first ball bearings
44 pair of first spacers
46 pair of second spacers
48 pair of first shafts
50 pair of second ball bearings
52 pair of third spacers
54 pair of second shafts D. Specific Configuration of Face-Pivoting Apparatus 40

56 necktie of face 30 of each animated figure of pair of animated FIG. 16
58 depending tail portion of necktie 56 of face 30 of each animated figure of pair of animated FIG. 16
60 third ball bearing
62 third spacer
64 third shaft
66 pair of fourth shafts
68 pair of rubber tubes

5. DETAILED DESCRIPTION OF THE PREFERRED EMBODIMENT

A. General

Referring now to the figures, in which like numerals indicate like parts, and particularly to FIGS. 1-3, which are, respectively, a diagrammatic perspective view of the animated-figures-rocked cradle of the embodiments of the present invention amusing and beginning to rocking an infant, a diagrammatic perspective view of the animated-figures-rocked cradle of the embodiments of the present invention amusing and rocking an infant in one direction, and a diagrammatic perspective view of the animated-figures-rocked cradle of the embodiments of the present invention amusing and rocking an infant in the opposite direction, the animated-figures-rocked cradle of the embodiments of the present invention is shown generally at 10 for amusing and rocking an infant 12.

B. The Overall Configuration of the Animated-Figures-Rocked Cradle 10

The animated-figures-rocked cradle 10 comprises a cradle 14 and a pair of animated FIG. 16. The cradle 14 is pivotally mounted to the pair of animated FIG. 16 and is for holding the infant 12. The pair of animated FIG. 14 support and rock the cradle 14 and are for amusing the infant 12.

The cradle 14 has a head 18 and a foot 20. The pair of animated FIG. 16 are disposed at the head 18 of the cradle 14 and at the foot 20 of the cradle 14, respectively.

Each animated FIG. 16 has a torso 22 with a pair of shoulders 24 and a head 26, a pair of arms 28, and a face 30. The pair of arms 28 of each animated FIG. 16 have upper ends 32, respectively, that are pivotally mounted to the pair of shoulders 24 of the torso 22 of an associated animated FIG. 16, respectively, and a pair of hands 34 that are pivotally mounted to an associated one of the head 18 of the cradle 14 and the foot 20 of the cradle 14 so as to give an impression that the pair of animated FIG. 16 are rocking the cradle 14. The face 30 of each animated FIG. 16 is pivotally mounted to the head 26 of the torso 22 of an associated animated FIG. 16 and pivots in unison with the pair of arms 28 of the pair of animated FIG. 16.

The pair of animated FIG. 16 can be of any form, such as humans, animals, etc., but preferably are, but are not limited to, clowns.

The animated-figures-rocked cradle 10 further comprises a storage chest 36. The storage chest 36 is for storing items of the infant 12, extends from one animated FIG. 16 to the other animated FIG. 16, and is accessible from and is disposed beneath the cradle 14 so as not to interfere with rocking of the cradle 14.

The animated-figures-rocked cradle 10 further comprises arm-pivoting apparatus 38. The arm-pivoting apparatus 38 pivotally mounts the pair of arms 28 of each animated FIG. 16 to the pair of shoulders 24 of the torso 22 of an associated animated FIG. 16 and to an associated one of the head 18 of the cradle 14 and the foot 20 of the cradle 14.

The animated-figures-rocked cradle 10 further comprises face-pivoting apparatus 40. The face-pivoting apparatus 40 pivotally mounts the face 30 of each animated FIG. 16 to the head 26 of the torso 22 of an associated animated FIG. 16.

C. The Specific Configuration of the Arm-Pivoting Apparatus 38

The specific configuration of the arm-pivoting apparatus 38 can best be seen in FIG. 4, which is an enlarged diagrammatic cross sectional view taken along LINE 4-4 in each of FIGS. 1-3 illustrating how each arm of each animated figure of the animated-figures-rocked cradle of the embodiments of the present invention is pivotally mounted to the pair of shoulders of the torso of an associated animated figure of the animated-figures-rocked cradle of the embodiments of the present invention and to the cradle of the animated-figures-rocked cradle of the embodiments of the present invention, and as such, will be discussed with reference thereto.

The arm-pivoting apparatus 38 comprises a pair of first ball bearings 42. The pair of first ball bearings 42 of the arm-pivoting apparatus 38 are disposed within the pair of shoulders 24 of the torso 22 of each animated FIG. 16.

The arm-pivoting apparatus 38 further comprises a pair of first spacers 44. The pair of first spacers 44 of the arm-pivoting apparatus 38 are disposed over the pair of first ball bearings 42 of the arm-pivoting apparatus 38, respectively, and maintain the pair of first ball bearings 42 of the arm-pivoting apparatus 38 within the pair of shoulders 24 of the torso 22 of each animated FIG. 16.

The arm-pivoting apparatus 38 further comprises a pair of second spacers 46. The pair of second spacers 46 of the arm-pivoting apparatus 38 are disposed over the pair of first spacers 44 of the arm-pivoting apparatus 38, respectively, and prevent friction when the pair of arms 28 of each animated FIG. 16 pivot relative to the pair of shoulders 24 of the torso 22 of an associated animated FIG. 16.

The arm-pivoting apparatus 38 further comprises a pair of first shafts 48. The pair of first shafts 48 of the arm-pivoting apparatus 38 pass fixedly through the upper ends 32 of the pair of arms 28 of each animated FIG. 16, respectively, rotatably through the pair of second spacers 46 of the arm-pivoting apparatus 38, respectively, rotatably through the pair of first spacers 44 of the arm-pivoting apparatus 38, respectively, and rotatably into the pair of first ball bearings 42 of the arm-pivoting apparatus 38, respectively.

The arm-pivoting apparatus 38 further comprises a pair of second ball bearings 50. The pair of second ball bearings 50 of the arm-pivoting apparatus 38 are disposed within each of the head 18 of the cradle 14 and the foot 20 of the cradle 14.

The arm-pivoting apparatus 38 further comprises a pair of third spacers 52. The pair of third spacers 52 of the arm-pivoting apparatus 38 are disposed over the pair of second ball bearings 50 of the arm-pivoting apparatus 38, respectively, and prevent friction when the pair of arms 28 of each animated FIG. 16 pivots relative to the cradle 14.

The arm-pivoting apparatus 38 further comprises a pair of second shafts 54. The pair of second shafts 54 of the arm-pivoting apparatus 38 pass fixedly through the pair of hands 34 of the pair of arms 28 of each animated FIG. 16, respectively, rotatably through the pair of third spacers 52 of the arm-pivoting apparatus 38, respectively, and rotatably into the pair of second ball bearings 50 of the arm-pivoting apparatus 38, respectively.

D. The Specific Configuration of the Face-Pivoting Apparatus 40

The specific configuration of the face-pivoting apparatus 40 can best be seen in FIGS. 5-8, which are, respectively, a diagrammatic perspective view with parts broken away illustrating the face of each animated figure of the animated-figures-rocked cradle of the embodiments of the present invention beginning to pivot relative to the head of an associated animated figure of the animated-figures-rocked cradle of the embodiments of the present invention, a diagrammatic perspective view with parts broken away illustrating the face of each animated figure of the animated-figures-rocked cradle of the embodiments of the present invention pivoting in one direction relative to the head of an associated animated figure of the animated-figures-rocked cradle of the embodiments of the present invention, a diagrammatic perspective view with parts broken away illustrating the face of each animated figure of the animated-figures-rocked cradle of the embodiments of the present invention pivoting in the opposite direction relative to the head of an associated animated figure of the animated-figures-rocked cradle of the embodiments of the present invention, and an enlarged diagrammatic cross sectional view taken along LINE 8-8 in each of FIGS. 5-7 illustrating how the face of each animated figure of the animated-figures-rocked cradle of the embodiments of the present invention is pivotally mounted to the head of an associated animated figure of the animated-figures-rocked cradle of the embodiments of the present invention and interfaces with the cradle of the animated-figures-rocked cradle of the embodiments of the present invention, and as such, will be discussed with reference thereto.

The face-pivoting apparatus 40 comprises the face 30 of each animated FIG. 16 having a necktie 56 with a depending tail portion 58.

As shown in FIG. 8, the face-pivoting apparatus 40 further comprises a third ball bearing 60. The third ball bearing 60 of the face-pivoting apparatus 40 is disposed within the head 26 of the torso 22 of each associated animated FIG. 16.

The face-pivoting apparatus 40 further comprises a third spacer 62. The third spacer 62 of the face-pivoting apparatus 40 is disposed over the third ball bearing 60 of the face-pivoting apparatus 40 and prevents friction when the face 30 of each animated FIG. 16 pivots relative to the head 26 of the torso 22 of an associated animated FIG. 16.

The face-pivoting apparatus 40 further comprises a third shaft 64. The third shaft 64 of the face-pivoting apparatus 40 passes fixedly through the face 30 of each animated FIG. 16, rotatably through the third spacer 62 of the face-pivoting apparatus 40, and rotatably into the third ball bearing 60 of the face-pivoting apparatus 40.

As shown in FIGS. 5-8, the face-pivoting apparatus 40 further comprises a pair of fourth shafts 66. The pair of fourth shafts 66 of the face-pivoting apparatus 40 are spaced horizontally apart from each other, extend fixedly from each of the head 18 of the cradle 14 and the foot 20 of the cradle 14, and freely straddle the depending tail portion 58 of the necktie 56 of the face 30 of each animated FIG. 16 so as to cause the depending tail portion 58 of the necktie 56 of the face 30 of an associated animated FIG. 16 to pivot when engaged against thereby as the cradle 14 rocks, thereby pivoting the face 30 of the associated animated FIG. 16 as the cradle 14 rocks.

The face-pivoting apparatus 40 further comprises a pair of rubber tubes 68. The pair of rubber tubes 68 of the face-pivoting apparatus 40 cover the pair of fourth shafts 66 of the face-pivoting apparatus 40, respectively, so as to eliminate noise when the depending tail portion 58 of the necktie 56 of the face 30 of each associated animated FIG. 16 engages against the pair of fourth shafts 66 of the face-pivoting apparatus 40.

E. Conclusions

It will be understood that each of the elements described above or two or more together may also find a useful application in other types of constructions differing from the types described above.

While the embodiments of the present invention have been illustrated and described as embodied in an animated-figures-rocked cradle for amusing and rocking an infant, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features from the standpoint of prior art fairly constitute characteristics of the generic or specific aspects of the embodiments of the present invention.

The invention claimed is:

1. An animated-figures-rocked cradle for amusing and rocking an infant, comprising:

a) a cradle; and b) a pair of animated figures;

wherein said cradle is pivotally mounted to said pair of animated figures;

wherein said cradle is for holding the infant;

wherein said pair of animated figures are for amusing the infant;

wherein said pair of animated figures support said cradle;

wherein said pair of animated figures rock said cradle;

wherein said cradle has a head;

wherein said cradle has a foot;

wherein said pair of animated figures are disposed at said head of said cradle and at said foot of said cradle, respectively;

wherein each animated figure has a torso;

wherein said torso of each animated figure has a pair of shoulders;

wherein said torso of each animated figure has a head;

wherein each animated figure has a pair of arms;

wherein each animated figure has a face;

wherein said pair of arms of each animated figure have upper ends;

wherein said upper ends of said pair of arms of each animated figure are pivotally mounted to said pair of shoulders of said torso of an associated animated figure, respectively;

wherein said pair of arms of each animated figure have a pair of hands;

wherein said pair of hands of said pair of arms of each animated figure are pivotally mounted to an associated one of said head of said cradle and said foot of said cradle so as to give an impression that said pair of animated figures are rocking said cradle; and wherein said face of each animated figure is pivotally mounted to said head of said torso of an associated animated figure.

2. The animated-figures-rocked cradle of claim 1, wherein said face of each animated figure pivots in unison with said pair of arms of an associated animated figure.

3. The animated-figures-rocked cradle of claim 1, wherein said pair of animated figures are selected from the group consisting of humans, animals, and clowns.

4. The animated-figures-rocked cradle of claim 1, further comprising a storage chest;

wherein said storage chest is for storing items of the infant;

wherein said storage chest extends from one animated figure to the other animated figure;

wherein said storage chest is disposed beneath said cradle so as not to interfere with rocking of said cradle; and wherein said storage chest is accessible from beneath said cradle;

wherein said storage chest is disposed beneath said cradle so as not to interfere with rocking of said cradle.

5. The animated-figures-rocked cradle of claim 1, further comprising arm-pivoting apparatus;

wherein said arm-pivoting apparatus pivotally mounts each said pair of arms of each animated figure to said pair of shoulders of said torso of an associated animated figure; and wherein said arm-pivoting apparatus pivotally mounts said pair of arms of each animated figure to an associated one of said head of said cradle and said foot of said cradle.

6. The animated-figures-rocked cradle of claim 1, further comprising face-pivoting apparatus; and wherein said face-pivoting apparatus pivotally mounts said face of each animated figure to said head of said torso of an associated animated figure.

7. The animated-figures-rocked cradle of claim 5, wherein said arm-pivoting apparatus comprises a pair of first ball bearings; and wherein said pair of first ball bearings of said arm-pivoting apparatus are disposed within said pair of shoulders of said torso of each animated figure.

8. The animated-figures-rocked cradle of claim 7, wherein said arm-pivoting apparatus comprises a pair of first spacers;

wherein said pair of first spacers of said arm-pivoting apparatus are disposed over said pair of first ball bearings of said arm-pivoting apparatus, respectively; and wherein said pair of first spacers of said arm-pivoting apparatus maintain said pair of first ball bearings of said arm-pivoting apparatus within said pair of shoulders of said torso of each animated figure.

9. The animated-figures-rocked cradle of claim 8, wherein said arm-pivoting apparatus comprises a pair of second spacers;

wherein said pair of second spacers of said arm-pivoting apparatus are disposed over said pair of first spacers of said arm-pivoting apparatus, respectively; and wherein said pair of second spacers of said arm-pivoting apparatus prevent friction when said pair of arms of each animated figure pivot relative to said pair of shoulders of said torso of an associated animated figure.

10. The animated-figures-rocked cradle of claim 9, wherein said arm-pivoting apparatus comprises a pair of first shafts; and wherein said pair of first shafts of said arm-pivoting apparatus pass fixedly through said upper ends of said pair of arms of each animated figure, respectively, rotatably through said pair of second spacers of said arm-pivoting apparatus, respectively, rotatably through said pair of first spacers of said arm-pivoting apparatus, respectively, and rotatably into said pair of first ball bearings of said arm-pivoting apparatus, respectively.

11. The animated-figures-rocked cradle of claim 5, wherein said arm-pivoting apparatus comprises a pair of second ball bearings; and wherein said pair of second ball bearings of said arm-pivoting apparatus are disposed within each of said head of said cradle and said foot of said cradle.

12. The animated-figures-rocked cradle of claim 11, wherein said arm-pivoting apparatus comprises a pair of third spacers;

wherein said pair of third spacers of said arm-pivoting apparatus are disposed over said pair of second ball bearings of said arm-pivoting apparatus, respectively; and wherein said pair of third spacers of said arm-pivoting apparatus prevent friction when said pair of arms of each animated figure pivots relative to said cradle.

13. The animated-figures-rocked cradle of claim 12, wherein said arm-pivoting apparatus comprises a pair of second shafts; and wherein said pair of second shafts of said arm-pivoting apparatus pass fixedly through said pair of hands of said pair of arms of each animated figure, respectively, rotatably through said pair of third spacers of said arm-pivoting apparatus, respectively, and rotatably into said pair of second ball bearings of said arm-pivoting apparatus, respectively.

14. The animated-figures-rocked cradle of claim 6, wherein said face-pivoting apparatus comprises said face of each animated figure having a necktie; and wherein the necktie of said face of each animated figure has a depending tail portion.

15. The animated-figures-rocked cradle of claim 14, wherein said face-pivoting apparatus comprises a third ball bearing; and wherein said third ball bearing of said face-pivoting apparatus is disposed within said head of said torso of each associated animated figure.

16. The animated-figures-rocked cradle of claim 15, wherein said face-pivoting apparatus comprises a third spacer;

wherein said third spacer of said face-pivoting apparatus is disposed over said third ball bearing of said face-pivoting apparatus; and wherein said third spacer of said face-pivoting apparatus prevents friction when said face of each animated figure pivots relative to said head of said torso of an associated animated figure.

17. The animated-figures-rocked cradle of claim 16, wherein said face-pivoting apparatus comprises a third shaft; and wherein said third shaft of said face-pivoting apparatus passes fixedly through said face of each animated figure, rotatably through said third spacer of said face-pivoting apparatus, and rotatably into said third ball bearing of said face-pivoting apparatus.

18. The animated-figures-rocked cradle of claim 14, wherein said face-pivoting apparatus comprises a pair of fourth shafts;

wherein said pair of fourth shafts of said face-pivoting apparatus are spaced horizontally apart from each other; and wherein said pair of fourth shafts of said face-pivoting apparatus extend fixedly from each of said head of said cradle and said foot of said cradle, and freely straddle said depending tail portion of said necktie of said face of each animated figure so as to cause said depending tail portion of said necktie of said face of an associated animated figure to pivot when engaged against thereby as said cradle rocks, thereby pivoting said face of said associated animated figure as said cradle rocks.

19. The animated-figures-rocked cradle of claim 18, wherein said face-pivoting apparatus comprises a pair of rubber tubes; and wherein said pair of rubber tubes of said face-pivoting apparatus cover said pair of fourth shafts of said face-pivoting apparatus, respectively, so as to eliminate noise when said depending tail portion of said necktie of said face of each associated animated figure engages against said pair of fourth shafts of said face-pivoting apparatus.

* * * * *